US010494232B2

(12) United States Patent
Sedlock

(10) Patent No.: US 10,494,232 B2
(45) Date of Patent: Dec. 3, 2019

(54) STRAP HOISTING DEVICE

(71) Applicant: U.S. Stage-It, LC, Hartville, OH (US)

(72) Inventor: Joseph John Sedlock, Hartville, OH (US)

(73) Assignee: U.S. Stage-It LC, Hartville, OH (US)

( * ) Notice: Subject to any disclaimer, the term of this patent is extended or adjusted under 35 U.S.C. 154(b) by 0 days.

(21) Appl. No.: 16/380,055

(22) Filed: Apr. 10, 2019

(65) Prior Publication Data

US 2019/0233255 A1 Aug. 1, 2019

Related U.S. Application Data

(63) Continuation of application No. 15/922,208, filed on Mar. 15, 2018, now Pat. No. 10,259,689.

(60) Provisional application No. 62/549,748, filed on Aug. 24, 2017.

(51) Int. Cl.

| | |
|---|---|
| ***B66C 1/38*** | (2006.01) |
| ***B66C 17/20*** | (2006.01) |
| ***B66C 1/16*** | (2006.01) |

(52) U.S. Cl.

CPC ..... *B66C 1/38* (2013.01); *B66C 1/16* (2013.01); *B66C 17/20* (2013.01)

(58) Field of Classification Search

CPC .... B66C 1/16; B66C 1/18; B66C 1/38; B66C 17/20

USPC ..... 294/74–76, 82.24, 82.36, 67.4

See application file for complete search history.

(56) References Cited

U.S. PATENT DOCUMENTS

| | | | | |
|---|---|---|---|---|
| 1,862,312 | A | 6/1932 | Kositzky | |
| 2,813,744 | A | 11/1957 | Hutchinson | |
| 4,181,342 | A | 1/1980 | Funk | |
| 4,251,099 | A | 2/1981 | Hubalek et al. | |
| 4,936,617 | A | 6/1990 | Greene et al. | |
| 7,431,363 | B1 | 10/2008 | Loney | |
| 10,259,689 | B2 * | 4/2019 | Sedlock | B66C 1/38 |

* cited by examiner

*Primary Examiner* — Dean J Kramer

(74) *Attorney, Agent, or Firm* — Sand, Sebolt & Wernow Co., LPA

(57) ABSTRACT

A hoist or hoisting device is configure to place a pallet on a roof without the need of a person on the roof. The hoist includes a deflector that moves between a first position and a second position and releases a strap from an open hook as the deflector moves from the first position. A release arm on the deflector contacts a portion of the strap to push the strap off the open hook after the pallet has contacted the roof. The hoist may then be raised and the strap be unthreaded and pulled upward through the pallet to leave the pallet installed on the roof.

16 Claims, 11 Drawing Sheets

STRAP HOISTING DEVICE

CROSS REFERENCE TO RELATED APPLICATIONS

This application is a continuation application of U.S. patent application Ser. No. 15/922,208 filed on Mar. 15, 2018, which claims the benefit of U.S. Provisional Application Ser. No. 62/549,748, filed on Aug. 24, 2017; the disclosure of which is incorporated herein by reference.

BACKGROUND

Technical Field

The present disclosure relates generally to a hoist or hoisting device utilized to lift a load from a first position to a second position. More particularly, the present disclosure relates to a hoisting device utilizing straps that enable a load to be carried from a first position to a second position and unloaded without the need of human intervention to unhook the straps from hooks on the hoisting device. Specifically, the present disclosure relates to a hoisting device that utilizes pivoting release arms to remove looped ends of straps from hooks on the hoisting device after the load has been lowered onto a support surface, such as a roof.

Background Information

Pallets are useful tools that carry materials from place to place. Often the pallets can be loaded with heavy materials that are difficult to move into a desired location. One example is a pallet stacked with shingles. Further to this example, the pallet may need to be loaded onto a roof. In some instances, the roof may be sloped and, in other instances, the roof may be flat. In each scenario, it often requires several workers to unload shingles onto the roof, which is tedious and expensive, and may also be dangerous for the workers located on the roof.

Lifting devices, which may also be referred to as hoisting devices, sometimes utilize straps that support the weight of the load being carried by a crane. In these instances, a worker located near the position where the load is to be placed must remove the straps.

SUMMARY

Issues continue to exist with lifting devices employing straps that require workers to unhook the straps to release the load. Namely, the presence of a worker may be dangerous in some scenarios if the surface is not ideal for a human operator to be standing. Thus, the need continues to exist for a hoisting device that can lift a heavy load, but can also manually release the strap used to carry the load after the load has been placed onto a support surface. The present disclosure addresses these and other issues.

In one exemplary aspect, an embodiment of the present disclosure may provide a hoisting device for lifting and placing a pallet on a rooftop, the hoisting device comprising: a support member including a first end and a second end defining a longitudinal direction therebetween, a first major surface opposite a second major surface defining a transverse direction therebetween, and a top and a bottom defining a vertical direction therebetween; a first pair of hooks connected to the support member adapted to connect with similar ends of two different straps; a second pair of hooks connected to the support member adapted to connect with other similar ends of the two different straps; and a deflector coupled to the support member configured to move between a first position and a second position, wherein the deflector passes the second pair of hooks when moving from the first position and is adapted to release the other similar ends of the two different straps from the second pair of hooks after a pallet has been disposed at an intended location. This exemplary embodiment or another exemplary embodiment may further provide a bent wire defining a portion of the deflector. This exemplary embodiment or another exemplary embodiment may further provide a release arm on the deflector positioned below the second pair of hooks configured to pass by the second pair of hooks and release the other similar ends of the two different straps as the deflector moves from the first position to the second position. This exemplary embodiment or another exemplary embodiment may further provide a vertical portion of the deflector positioned between one hook from the first pair of hooks and one hook from the second pair of hooks. This exemplary embodiment or another exemplary embodiment may further provide a bend in the deflector defining an angle between about 45 degrees and about 90 degrees, wherein the bend encourages the deflector to pivot about a pivot axis from the first position to the second position. This exemplary embodiment or another exemplary embodiment may further provide a portion of the deflector extending downwardly and inwardly from the pivot axis towards the bend. This exemplary embodiment or another exemplary embodiment may further provide a first color associated with the first major surface adapted to identify the direction in which the deflector moves from the first position to the second position; and a different second color associated with the second major surface to identify a portion of the support member relative to which the deflector does not move. This exemplary embodiment or another exemplary embodiment may further provide wherein the support member is a rigid plate. This exemplary embodiment or another exemplary embodiment may further provide a bottom edge of the plate wherein the second pair of hooks extend vertically below the bottom edge. This exemplary embodiment or another exemplary embodiment may further provide wherein the first pair of hooks extend vertically below the bottom edge. This exemplary embodiment or another exemplary embodiment may further provide wherein the first pair of hooks are closed hooks and the second pair of hooks are open hooks. This exemplary embodiment or another exemplary embodiment may further provide wherein the first pair of hooks are positioned outward from the second pair of hooks relative to a central vertical axis. This exemplary embodiment or another exemplary embodiment may further provide a pivot axis about which the deflector pivots, wherein the pivot axis is vertically above the bottom edge. This exemplary embodiment or another exemplary embodiment may further provide wherein the top of the plate defines an apex and the plate includes downwardly longitudinal inclined edges extending respectively outward to the first and second ends. This exemplary embodiment or another exemplary embodiment may further provide a hole formed in the rigid plate positioned above the pivot axis and below the apex configured to connect the plate with a hook on a cable connected to a crane.

In another exemplary aspect, an embodiment of the present disclosure may provide a method of installing a pallet on a roof comprising: lowering a hoist having a first end of a strap connected to an open hook and a second end of the strap connected to a closed hook; moving a first portion of a deflector coupled to a support member on the hoist from a first position by the open hook; releasing the first end of the strap from its connection with the open hook in response to the first portion of the deflector moving by the open hook. This exemplary embodiment or another exemplary embodiment may further provide contacting wheels on the hoist with an object carried by the pallet; and pivoting the deflector about a pivot axis from the first position. This exemplary embodiment or another exemplary embodiment may further provide raising the hoist after the first end of the strap has been released; and pulling the strap through a portion of the pallet from the second end of the strap connected to the closed hook. This exemplary embodiment or another exemplary embodiment may further provide pivoting a vertical portion of the deflector between the open hook and the closed hook. This exemplary embodiment or another exemplary embodiment may further provide rotating the deflector in a direction towards a first major surface on the hoist; and precluding rotation of the deflector in a direction towards a second major surface on the hoist.

In another exemplary aspect, an embodiment of the present disclosure may provide a hoist or hoisting device that is configured to place a pallet on a roof without the need of a person on the roof. The hoist includes a deflector that moves between a first position and a second position and releases a strap from an open hook as the deflector moves from the first position. A release arm on the deflector contacts a portion of the strap to push the strap off the open hook after the pallet has contacted the roof and the hoist continues to be lowered such that wheels on the hoist contact the load supported by the pallet. A crane may then raise the hoist and the strap be unthreaded and pulled upward through the pallet to leave the pallet installed on the roof.

BRIEF DESCRIPTION OF THE SEVERAL VIEWS OF THE DRAWINGS

A sample embodiment of the disclosure is set forth in the following description, is shown in the drawings and is particularly and distinctly pointed out and set forth in the appended claims. The accompanying drawings, which are fully incorporated herein and constitute a part of the specification, illustrate various examples, methods, and other example embodiments of various aspects of the disclosure. It will be appreciated that the illustrated element boundaries (e.g., boxes, groups of boxes, or other shapes) in the figures represent one example of the boundaries. One of ordinary skill in the art will appreciate that in some examples one element may be designed as multiple elements or that multiple elements may be designed as one element. In some examples, an element shown as an internal component of another element may be implemented as an external component and vice versa. Furthermore, elements may not be drawn to scale.

Similar numbers refer to similar parts throughout the drawings.

DETAILED DESCRIPTION

As depicted throughout the figures, a first embodiment of a hoisting device utilizing straps is shown generally at 10 in FIGS. 1-7. A second embodiment of a hoisting device utilizing straps is shown generally at 110 in FIG. 8. Hoisting device 10 or 110 is designed to lift a load, such as a pallet 12 carrying shingles 14 thereon, and be able to release straps 16 without the need for direct operator engagement. Stated otherwise, hoisting device 10 or 110 can release straps 16 without a workman performing any manual removal. Further, the device 10 or 110 can release the pallet full of shingles 14 onto a roof without humans present on the rooftop. This reduces costs and results in cost savings for moving the load, such as pallet 12, from a first position to a second position. This may further improve safety factors inasmuch as it reduces the amount of time that people are on the rooftop.

Figure 1:
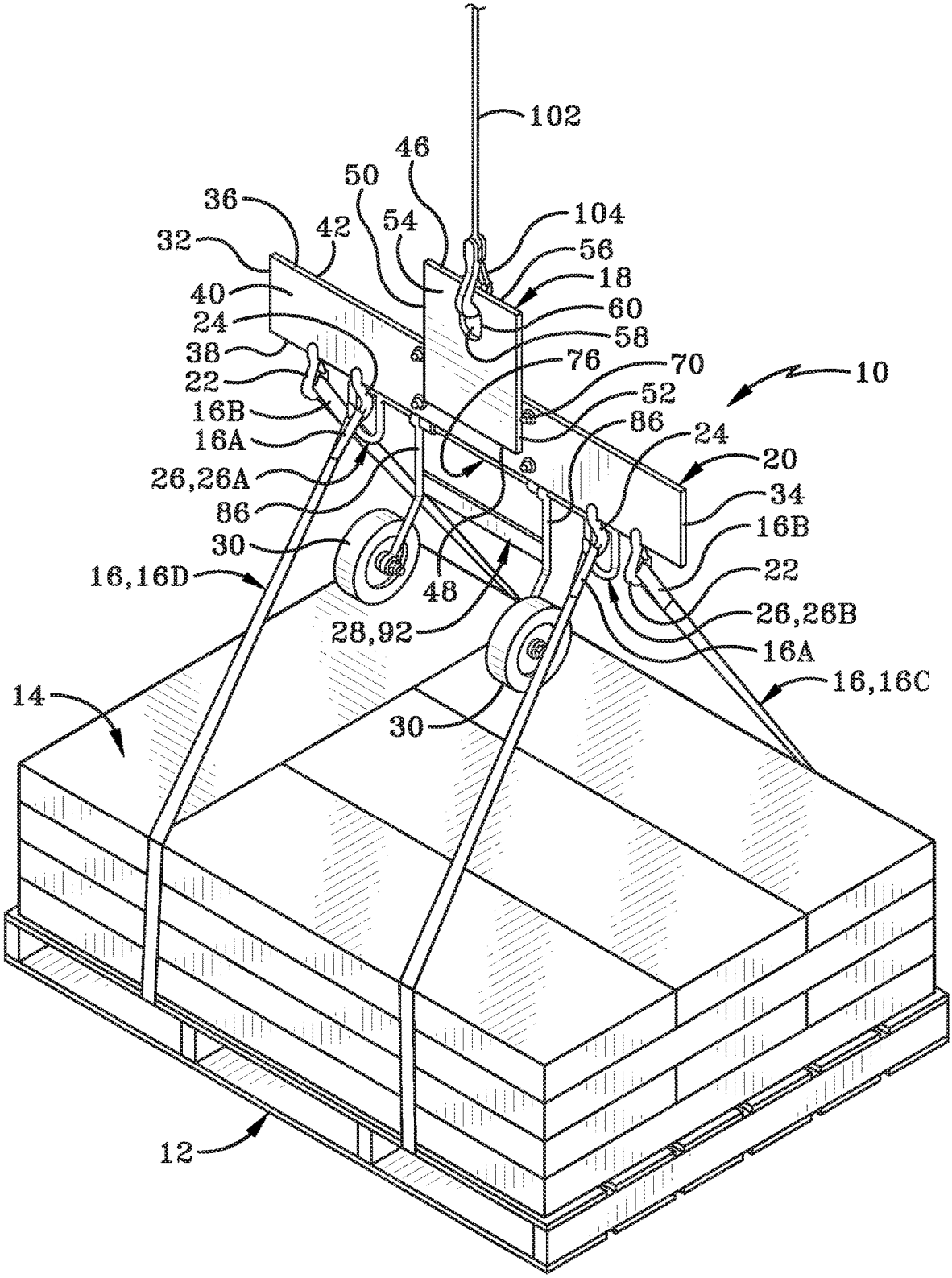
FIG. 1 (FIG. 1) is an operational perspective view of a hoisting device in accordance with the present disclosure lifting a load.
Figure 2:
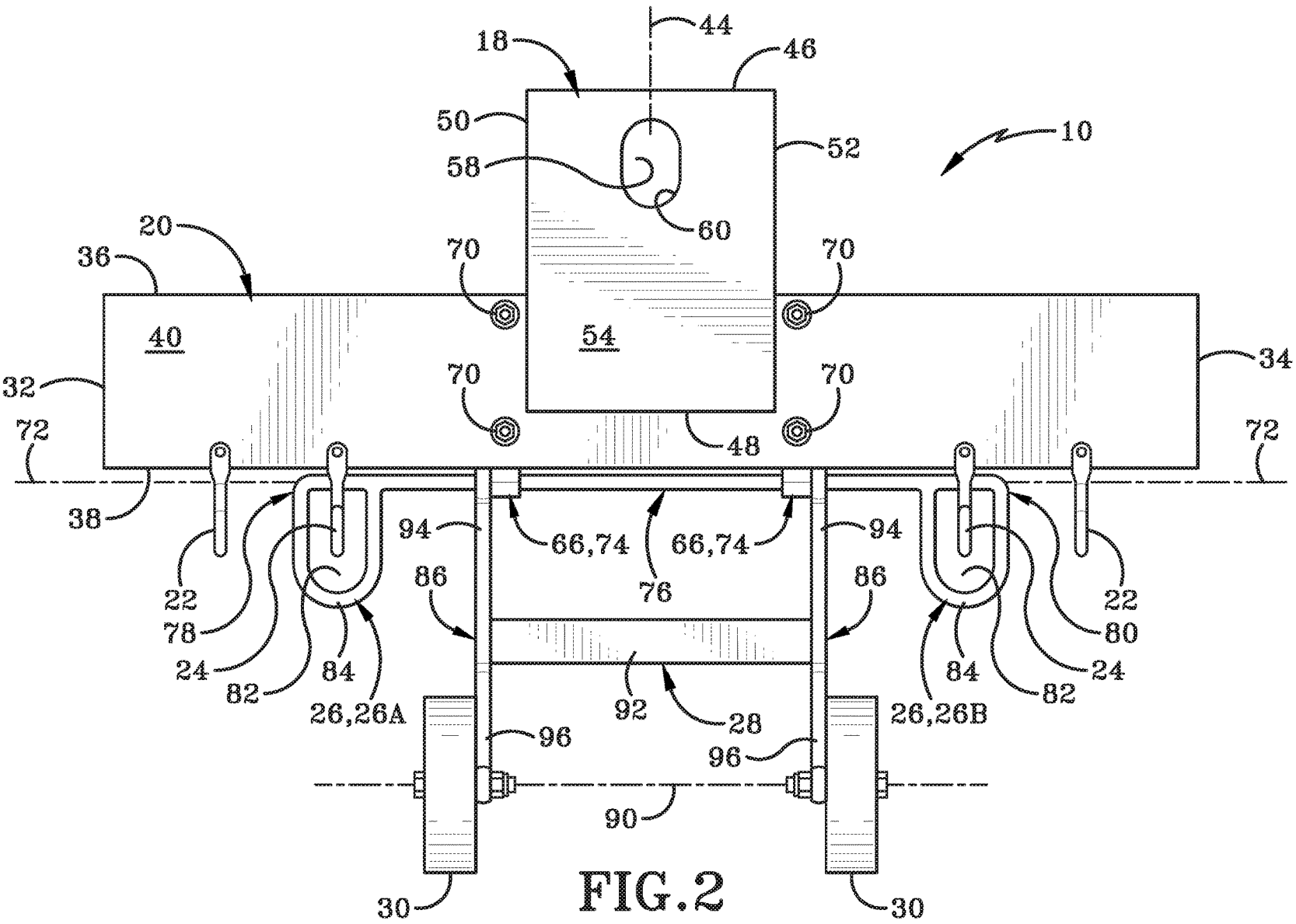
FIG. 2 (FIG. 2) is a front elevation view of the hoisting device of the present disclosure.

As depicted in FIG. 2, one exemplary embodiment of hoisting device 10 includes an upper extension 18, a longitudinally-extended support member 20, a pair of closed hooks 22 (which may also be referred to as a first pair of hooks), a pair of open hooks 24 (which may also be referred to as a second pair of hooks), a pair of release arms 26, a pivot arm frame 28, and at least one wheel 30.

Figure 4:
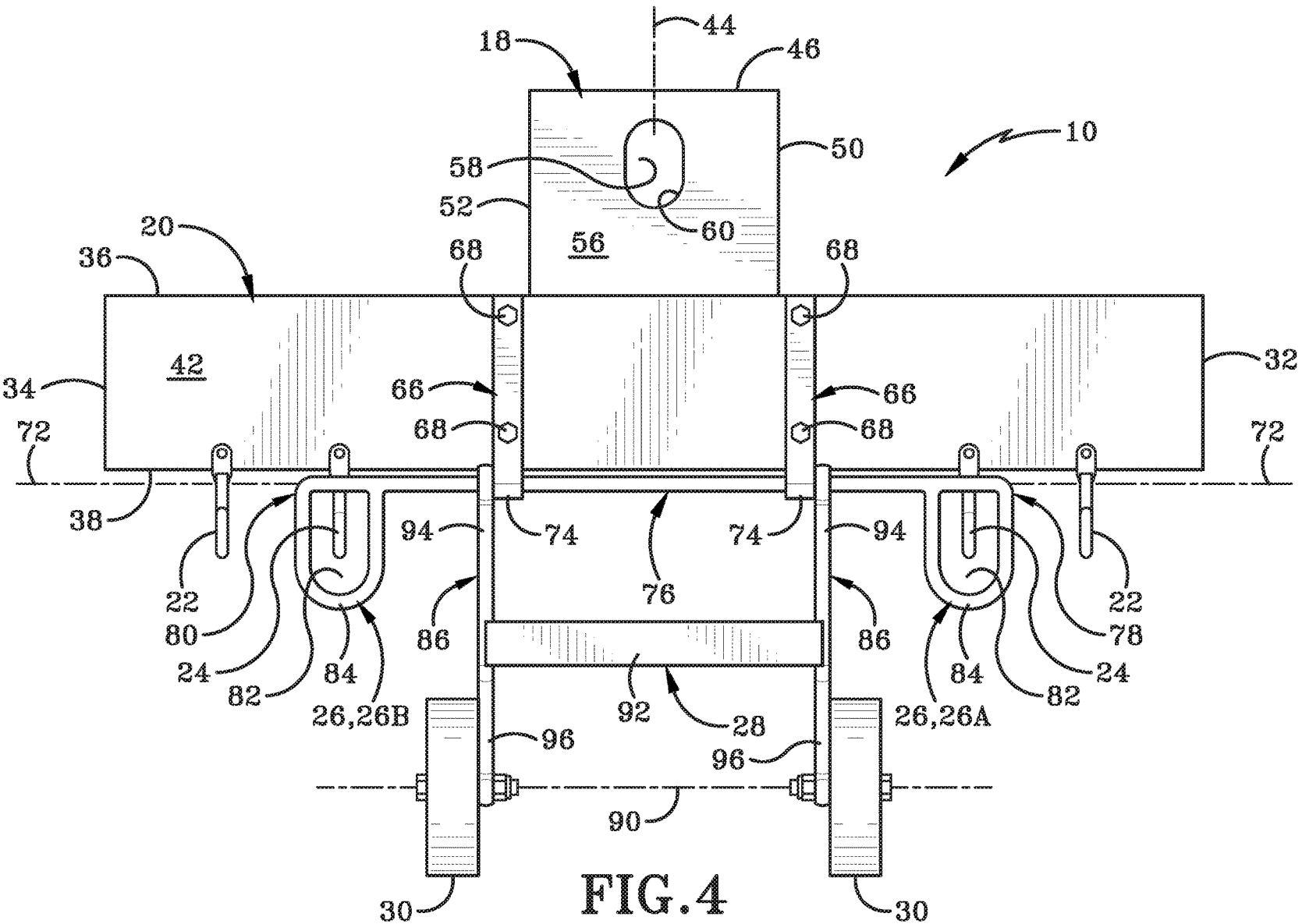
FIG. 4 (FIG. 4) is a rear elevation view of the hoisting device in accordance with the present disclosure.

With continued reference to FIG. 2 and FIG. 4, the longitudinally-extending support member includes a first end 32 opposite a second end 34, defining a longitudinal direction therebetween. Longitudinally extending support member 20 includes a first edge 36 opposite a second edge 38 defining a vertical direction therebetween. Longitudinally extending support member 20 includes a first major surface 40 opposite a second major surface 42 defining a transverse direction therebetween. Inasmuch as longitudinally extending support member 20 is a substantially rigid plate, a transverse width or thickness is established between first major surface 40 and second major surface 42. Accordingly, first edge 36 and second edge 38 may have minor surfaces associated with the thickness thereof. Likewise, first end 32 and second end 34 may have a thickness which establishes a minor surface. The major surfaces of first surface 40 and second surface 42 have a surface area that is significantly greater than the minor surfaces established by the first end 32, the second end 34, the first edge 36, or the second edge 38.

Support member 20 may be fabricated from a number of different materials; however, metal is a preferred substance inasmuch as it provides strength for lifting heavy loads which is the purpose of hoisting device 10. While support member 20 has been shown to be generally rectangular in shape as a planar piece of rigid material, other configurations are entirely possible, such as a tubular design or another symmetrical or an asymmetrical design, or any other supported design that can accomplish similar objectives to release a load without the need of a workman as will be described in greater detail below, such as the design provided in the second embodiment hoisting device 110.

The extension member 18 is a rigid and structurally supportive member that is centered along a vertical center line 44. Extension member 18 includes a first edge 46 opposite a second edge 48, and a first end 50 opposite a second end 52. In one particular embodiment, second edge 48 is substantially parallel to first edge 36 and second edge 38 of support member 20. In one particular embodiment, first edge 48 is disposed below the first edge 36 and above the second edge 38 of support member 20. However, other configurations may be possible where second edge 48 is substantially coplanar with or below second edge 38 of support member 20.

First and second ends 50, 52 of extension member 18 intersect first edge 36 in a generally perpendicular manner. The first edge 46 is located vertically above first edge 36 of support member 20 such that a portion of extension member 18 rises above the first edge 36 of support member 20. Extension member 18 further includes a first major surface 54 opposite a second major surface 56. A transversely aligned aperture is formed in the extension member 18 and extends fully therethrough from the first surface 54 and the second surface 56. In one particular embodiment, the aperture 58 formed in the extension member 18 is entirely above the first edge 36 of support member 20. Additionally, aperture 58 is vertically symmetric relative to vertical center line 44. In another particular embodiment, aperture 58 is bound by an oval edge 60 which gives the aperture 58 an oval shape.

Figure 3:
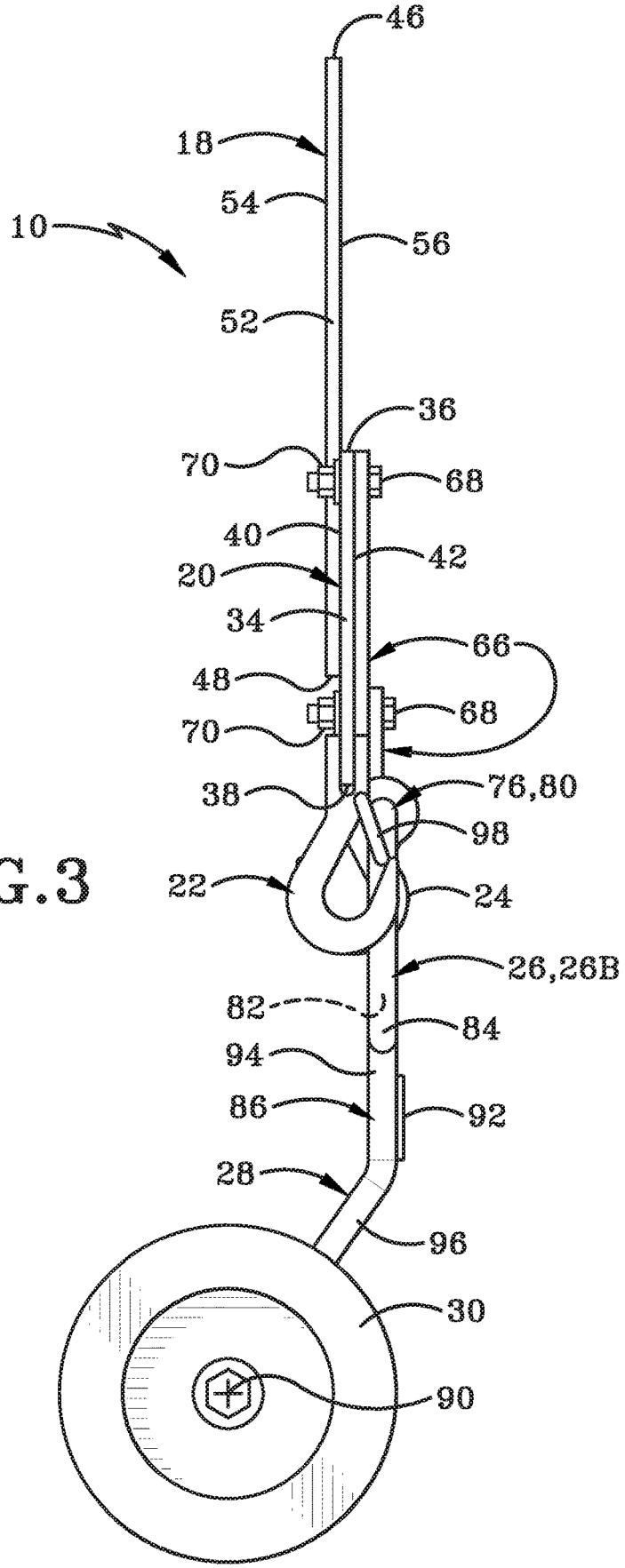
FIG. 3 (FIG. 3) is a side elevation view of the hoisting device in accordance with the present disclosure.

As depicted in FIG. 3, the second surface 56 of extension member 18 directly abuts first surface 40 of support member 20. In one particular embodiment, extension member 18 may be rigidly connected to longitudinally extending support member 20 such that the portion of extension member 18 extending above the first edge 36 of support member 20 extends in a cantilevered manner relative to support member 20.

With continued reference to FIG. 2 and FIG. 4, a pair of rigid straps 66 is connected with support member 20 along its second surface 42. Straps 66 can be rigidly connected to support member 22 via a plurality of bolts 68 which extend transversely through the support member 20 and are secured in place via nuts 70. Straps 66 are generally vertically-aligned rigid members that include a looped end defining a longitudinally aligned hole centered along a pivot axis 72 below second edge 38. The end 74 of strap 66 defining the longitudinally aligned hole may be formed in a variety of different ways. However, one contemplated manner in which the looped end 74 of strap 66 is formed is by curling the end back on its itself so as to define the hole at end 74. In one particular embodiment, there may be two straps 66, as shown throughout the figures; however, an alternative number of straps 66 is entirely possible.

The looped ends 74 defining longitudinally-extending holes along pivot axis 72 receive a rigid axle 76 therethrough. Rigid axle 76 extends longitudinally and has a diameter smaller than the looped ends 74 and is able to freely rotate therein about pivot axis 72. Rigid axle 76 spans the vertical center line 44 of device 10 below the second edge 38 of support member 20. In one particular embodiment, axle 76 is substantially parallel to second edge 38 of support member 20. Axle 76 extends longitudinally from a first end 78 to a second end 80. A first release arm 26A extends from a rigid connection in a cantilevered manner from adjacent the first end 78 of axle 76. In one particular embodiment, first release arm 26A completes a loop so as to define a substantially D-shaped release arm. However, other shapes of the first release arm 26 are entirely possible and a full, complete loop is not necessary so as to create an alternative shape.

The shape of first arm 26A defines a space 82 between the first arm 26A and one of the pair of open hooks 24. Space 82 is designed to allow first arm 26A to pass around one of the open hooks 24. A lower portion 84 of the first arm 26A extends below the lower portion of open hook 24 and is configured to move in unison with the first release arm 26A as the axle 76 rotates about pivot axis 72.

The first end 78 of axle 76 terminates longitudinally outward, relative to vertical center line 44, from one of the open hooks 24. The first end 78 terminates longitudinally inward, relative to vertical center line 44, from one of the closed hooks 22. Additionally, at least a portion of the first release arm 26A is connected with a first end 76 such that a portion of the first release arm 26A is located intermediate one open hook 24 and one closed hook 22. The manner in which the first release arm 26A is rigidly connected to the axle 76 may be effectuated in a number of different ways; however, it would be simple for the axle 76 and the release arm 26 to be formed from a single piece of metal that is bent to effectuate the shape described herein. However, other manners in fabricating the axle and release arm 26 are entirely possible, such as welding pieces of metal or other rigid materials together.

A second release arm 26B is shaped similar to the first release arm 26A and has similar reference elements denoting similar parts. Additionally, the second end 80 of axle 76 is located between one open hook 24 and one closed hook 22. Notably, the pair of open hooks 24 is located longitudinally inward, relative to vertical center line 44, from the pair of closed hooks 22. Stated otherwise, the pair of closed hooks 22 is respectively closer to first end 32 and second end 34 of support member 20 than the pair of open hooks 24. Likewise, the pair of open hooks 24 is closer to the wheels 30 than the pair of closed hooks 22. The longitudinal gap separating one closed hook 22 from one open hook 24 should be sufficient to fit at least a portion of the release arm 26 therebetween.

The pivot arm frame 28 includes a pair of extension legs 86 that extend in a cantilevered manner from a rigid connection with axle 76. In one particular embodiment, the legs 86 are rigidly connected with axle 76 outwardly from the looped end 74 of straps 66 relative to vertical center lines 44. The rigid connection of the ends of legs 86 are located inwardly from the release arms 26. Each one of the pair of extension legs 86 extends to an end which supports a wheel 30 thereon configured to rotate about an axis 90. Axis 90 is longitudinally aligned and offset parallel to pivot axis 72. A cross member 92 may extend between extension legs 86 and may be substantially parallel to support member 20. Cross member 92 enables the pair of extension legs 86 to rotate in unison about axis 72 as will be described in greater detail below. Cross member 92 is rigidly connected with extension legs 86 such that cross member 92 moves in unison so as to revolve around pivot axis 72 simultaneous with the extension arms 86 and the wheels 30.

As depicted in FIG. 3, the extension legs may include an upper portion 94 and a lower portion 96. Upper portion 94 may be aligned substantially vertical and the lower portion 96 may be angled relative to vertical. In one particular embodiment, the lower portion 96 extends forwardly in the direction of first surface 40 of support member 20 at an angle of about 45°. The about 45° angle extension of lower portion 46 is not intended to be limited and other embodiments within the scope of the present disclosure provide that the lower extension may extend forwardly at any angle between about 10° and about 80°. The lower portion 96 offsets a portion of the wheels forwardly from the first surface 40 of support member 42. More particularly, axis 90 of wheel 30 is positioned forwardly from the first major surface 40 of support member 20. Additionally, axis 90 is positioned forwardly from the upper portion 94 of extension leg 86. The purpose of the lower extension positioning the wheels 30 in a generally forward manner will be described in greater detail below, but its purpose is to encourage the wheels to translate forwardly (in a direction towards the left as depicted in FIG. 3).

In accordance with one aspect of the present disclosure, hoisting device 10 is designed to enable loads to be lifted via a crane and released from the same without the need of a human operator to remove the straps from the hoisting device.

Figure 5:
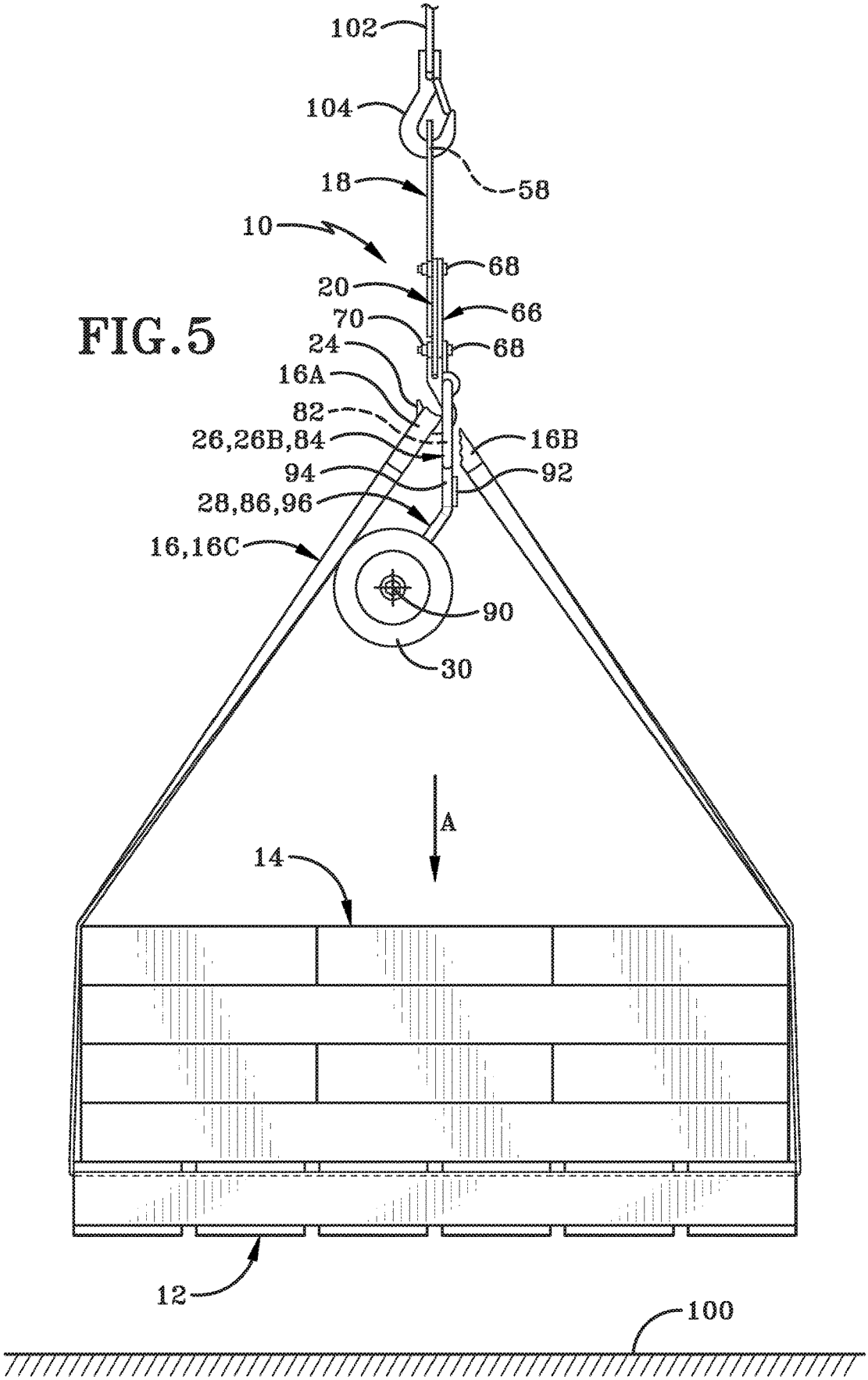
FIG. 5 (FIG. 5) is an operational side elevation view of the hoisting device after lifting a load from a first position and lowering the same towards a second position.
Figure 5A:
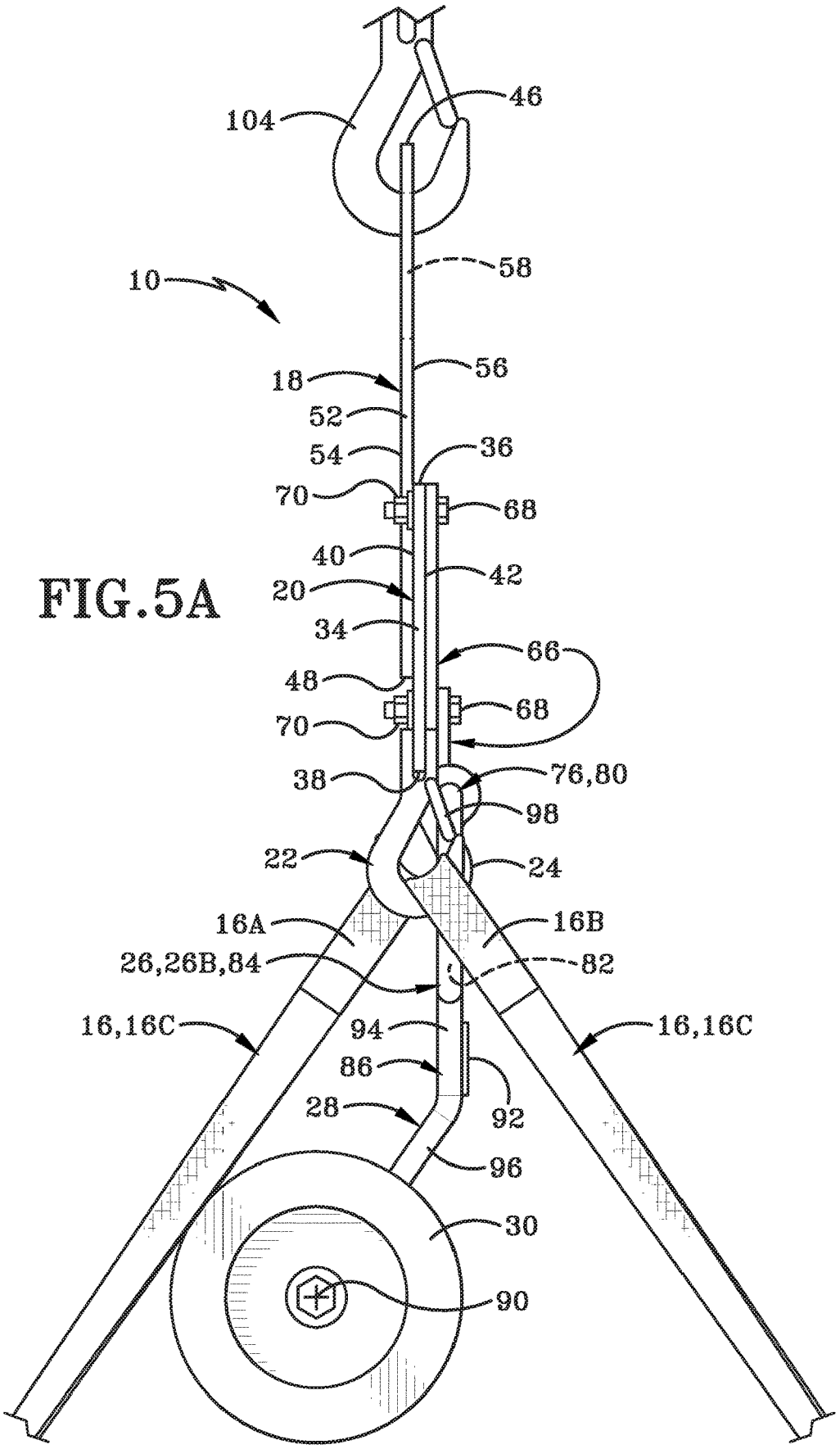
FIG. 5A (FIG. 5A) is an enlarged side elevation view of depicting the connection of a strap to the hoisting device.

FIG. 5 and FIG. 5A depict the operational aspects of the hoisting device 10. Initially, it is noted that straps 16 include a first end 16A and a second end 16B. Each end 16A, 16B at the straps 16 forms a loop which is sized to connect with one of the hooks on the hoisting device 10. In one particular embodiment, the first end 16A of strap 16 is hooked onto one of the open hooks 24 and the second end 16B of straps 16 is connected with one of the closed hooks 22. Closed hooks 22 are referred to as a closed hook inasmuch as they include a spring closure 98, which enables the second end 16B to be hooked onto the closed hook 22, but to not slide off. In a particular embodiment, strap 16 is connected with the open hook 24 that is closely adjacent to the closed hook 22. For example, the straps 16 is connected with the open hook 24 and the closed hook 22 that are both offset at the same side of vertical center line 44.

In one particular embodiment, a first strap 16C having a first end 16A and a second end 16B is used in conjunction with a second strap 16D having a first end 16A and a second end 16B. First strap 16C is offset entirely to one side of vertical center line 44 and the second strap 16D is offset entirely to an opposite second side of vertical center line 44. Each respective strap 16C, 16D is threaded below the load, such as pallet 12 and is configured to support the same.

With the first and second straps 16C, 16D threaded beneath the load, such as pallet 12, the load may be hoisted from a first position to a second position. FIG. 5 depicts the lowering of the load from the first position towards the second position. Lowering the load is indicated by arrow A. The load is lowered in the direction of arrow A to a support surface 100 which may be a ground surface or an elevated surface such as a roof. In the event that surface 100 is a roof, a roof may be sloped and may does not necessarily need to be horizontal or parallel to the ground. Thus, the hoisting device 10 is effective regardless of the slope of the surface 100 for which the load is being positioned atop. During the lowering movement of the load in the direction of arrow A, hoisting device 10 does not contact the materials supported or established by the load. In this particular example, the hoisting device 10 does not touch the shingles 14 stacked upon the pallet when the load is above surface 100.

Figure 6:
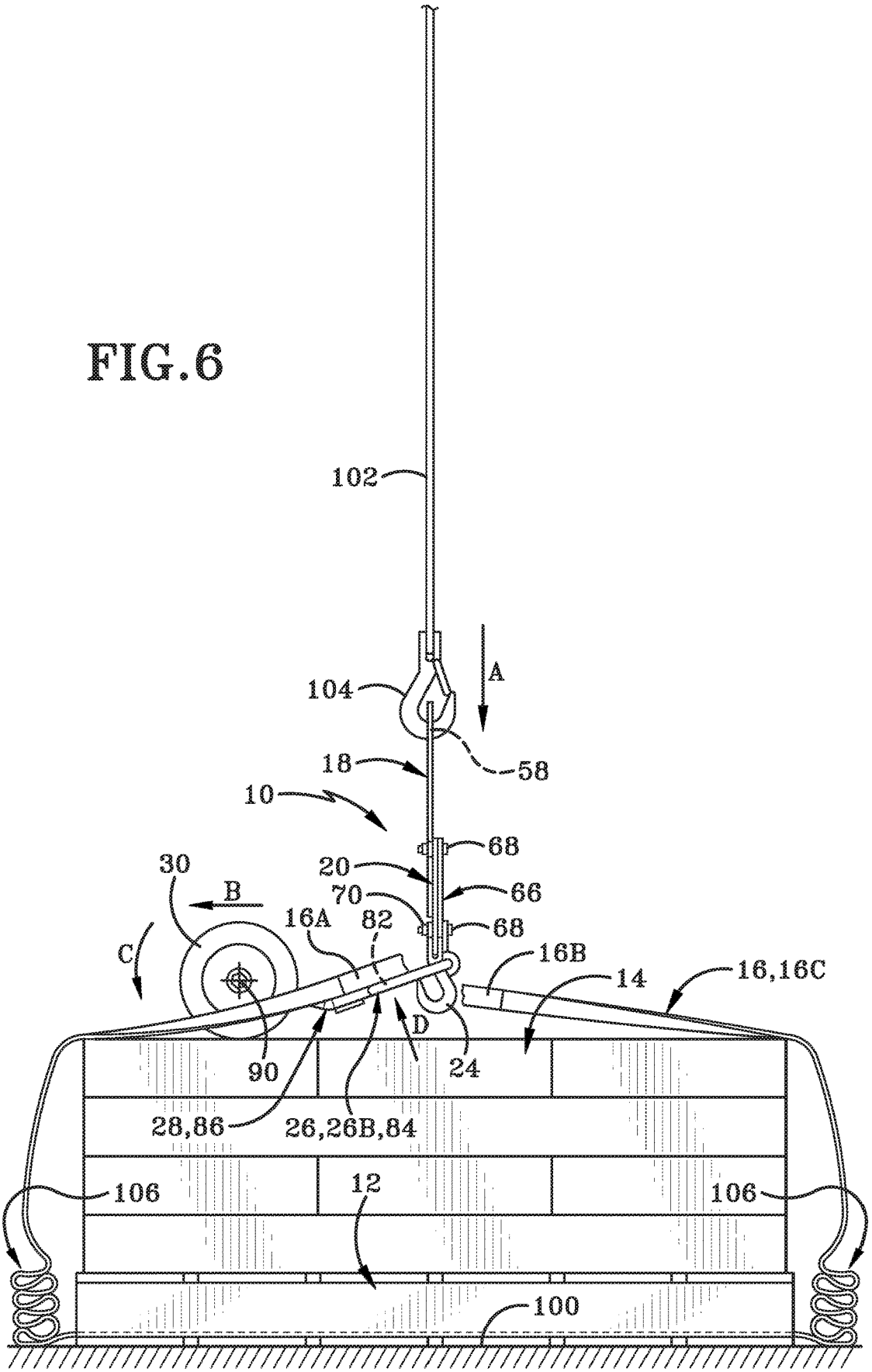
FIG. 6 (FIG. 6) is an operational side elevation view of hoisting device lowering the load and automatically disconnecting the strap from the hoisting device without the need of an operator.

FIG. 6 depicts the operation of the hoisting device 10 after the load, such as the pallet 12 carrying shingles 14, has been lowered onto the surface 100 and is supported by the same. When the load is supported by the surface 100, the crane continues to lower cable 102 which is releasably connected via clip 104 to the extension member 18 through the aperture 58 downwardly in the direction of arrow A. The first and second straps 16C, 16D release their tension in support of the load and create slack 106 on each adjacent side of the load.

As the hoisting device 10 continues to be lowered, the wheels 30 make contact with the upwardly facing surface of the load, which is in this case is shingles 14. Because the wheels are positioned with a forward bias based on the angled lower portion 96 of the extension arm 86, the wheels rotate about axis 90 causing translation of the wheels in the direction of arrow B, which is orthogonal to the direction of arrow A. The orthogonal translation in the direction of arrow B of wheels 30 occurs as the wheels rotate in the direction of arrow C about wheel rotation axis 90. The translation of wheels 30 in the direction of arrow B causes the extension legs 86 pivot about pivot axis 72. Because of the rigid connection of extension arms 86 to axle 76, the pivoting action of extension arms 86 around pivot axis 72 causes axle 76 to rotate about axis 72 as well. The rotation of axle 76 about axis 72 causes the first arm 26A and the second release arm 26C to rotate upwardly in a direction of arrow D. Because the release arms extend past the lowest portion of open hooks 24 effectuating space 82, when the first and second release arms 26A, 26B rotate upwardly about axis 72 in the direction of arrow D, the release arms contact end 16A and cause the first end 16A of strap 16 to be released from its looped engagement with the open hooks 24.

Figure 7:
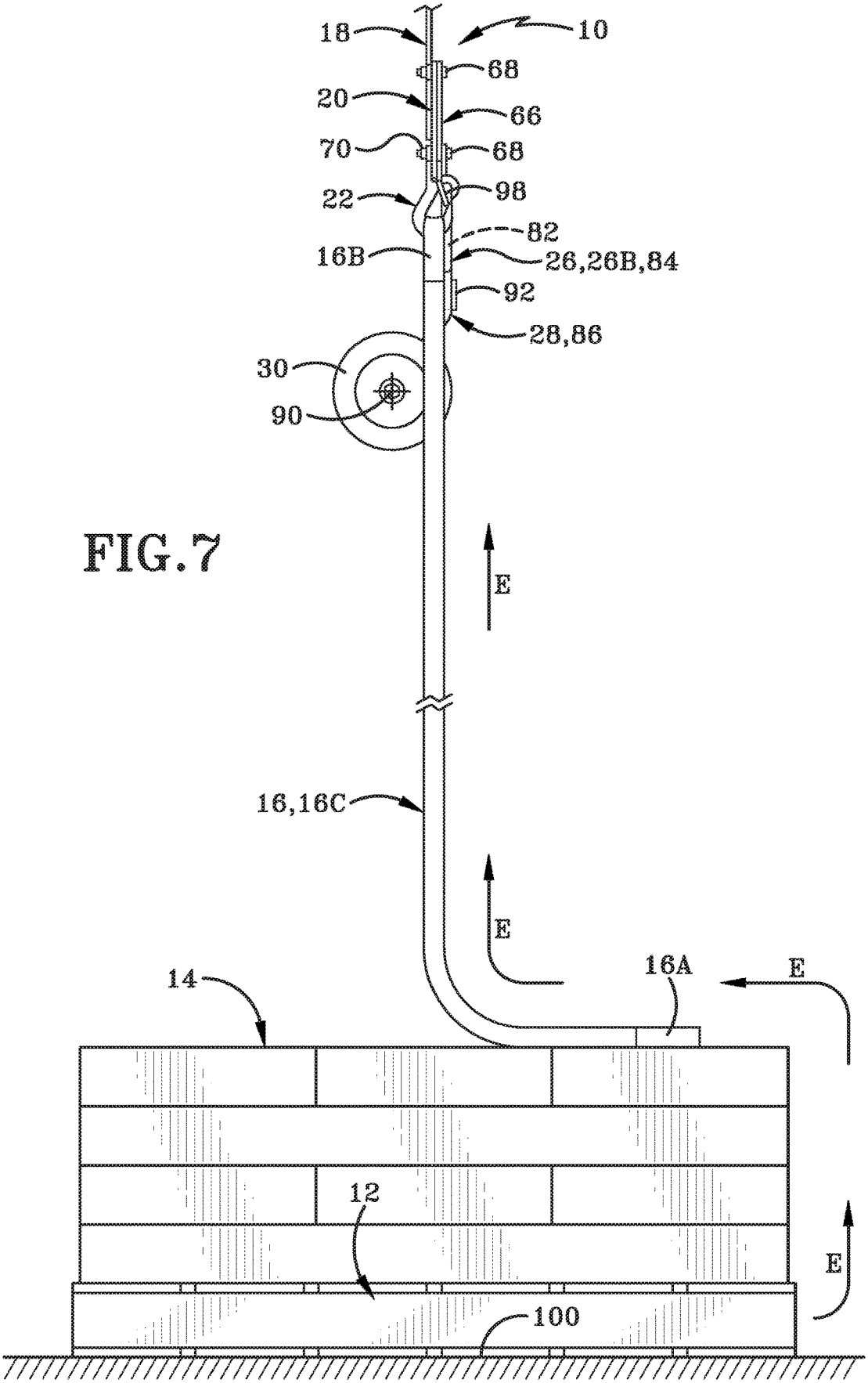
FIG. 7 (FIG. 7) is an operational side elevation view depicting the strap being removed from one of the hooks on the hoisting device without human intervention and being removed from the load so as to position the load in a desired location.

As depicted in FIG. 7, after the first end 16A of strap 16 has been disconnected from the open hooks 24, the crane may hoist cable 102 upwardly which enables the strap 16 to unthread or otherwise pass through a portion of the load in the direction of arrow E. In this particular instance, the strap 16 passes through the pallet 12 and allows the pallet to be fully supported by the surface. In accordance with an aspect of the present disclosure, the ability of the device 10 to unhook the first end 16A of the loop strap 16 enables the load, such as pallet 12 carrying shingles 14, to be placed upon a support surface 100 without the need of an operator to unhook the straps 16 from various hooks on the hoisting device.

Figure 8:
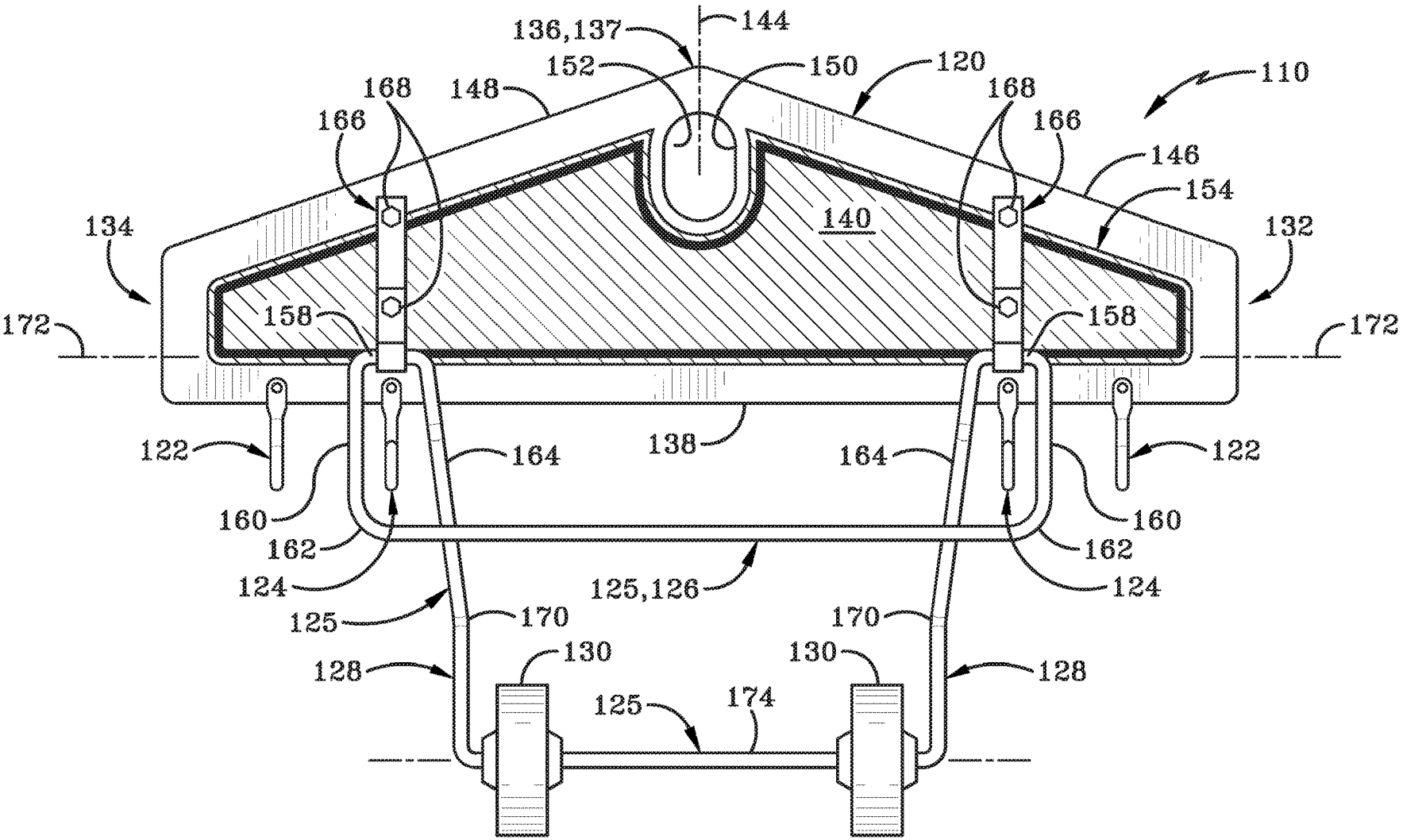
FIG. 8 (FIG. 8) is a front elevation view of a hoist in accordance with another embodiment of the present disclosure.

As depicted in FIG. 8, another exemplary embodiment of hoisting device 110 includes a monolithic, uniform, unibody support plate or member 120, a pair of closed hooks 122, a pair of open hooks 124, at least one bent wire 125 which may define at least one release arm 126 and a deflector arm 128, and at least one wheel 130 carried by the wire.

Figure 9:
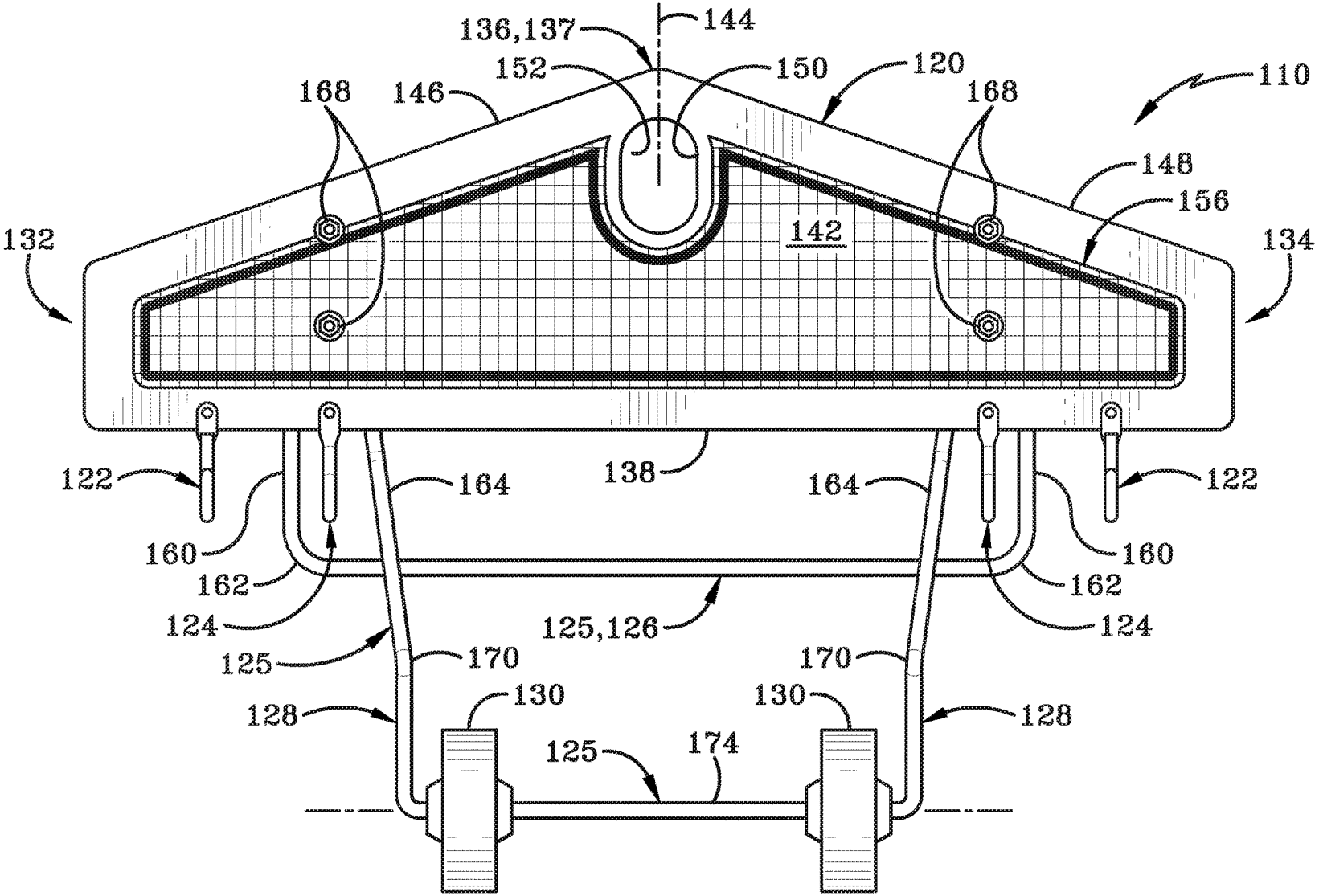
FIG. 9 (FIG. 9) is a rear elevation view of the hoist depicted in FIG. 8.

With continued reference to FIG. 8 and FIG. 9, the plate 120, which may also be generally referred to herein as a support member, includes a first side 132 opposite a second side 134 defining a longitudinal direction therebetween. The plate 120 further includes a top 136 defining an apex 137 and a longitudinally extending bottom edge 138 defining a vertical direction therebetween. Plate 120 includes a first major surface 140 opposite a second major surface 142 defining a transverse direction therebetween. A vertical axis 144 extends centrally between the first side 132 and the second side 134. The vertical axis 144 intersects the bottom edge 138 in a perpendicular manner and extends centrally through the apex 137. The plate 120 further includes a first inclined upper edge 146 associated with the first side 132 of the plate 120 and a second included upper edge 148 associated with the second side 134 of the plate 120. The first inclined upper edge 146 extends downwardly at an angle between 0 and 90° relative to the vertical axis 144. The second inclined upper edge 148 extends downwardly from the apex 137 at an angle relative to the vertical axis 144 that is similar to the first edge 146. The similar angles defined between angle 144 for the edges 146, 148 establish that the plate 120 is symmetrical about the vertical axis 144. In one particular embodiment, the angle defined between the inclined edges 146, 148 and the vertical axis 144 is about 60°.

The plate 120 further includes an at least partially arcuate edge 150 defining and bounding a transverse through aperture 152 extending completely through the plate 120 from the first major surface 140 to the second major surface 142. In one embodiment the edge 150 defines an oval-shaped aperture or hole 152, however other shapers are entirely possible. The dimensions associated with the edge 150 define the hole 152 are sufficiently sized to receive the hook 104 on the cable 102 therethrough.

Plate 120 may be fabricated from a variety of structural and rigid materials sufficient to hoist heavy loads. In one particular embodiment, plate 120 is formed from a unibody, uniform and substantially strong and rigid metal, such as stainless steel.

The plate 120 may further include a decal 154 adhered to at least a portion of the first major surface 140. Of particular note, the decal 154 associated with the first major surface 140 of the plate 120 is printed with a different color, such as green, than the decal 156 located and adhered to the second major surface 142 on the plate 120. The purpose of the decal 154 being a different color than the decal 156 is to identify and enable the crane operator, who can often be on the order of 30 feet to hundreds feet away from the hoist 110 as it is lowering a pallet 12, or another type of pallet such as pallet 112 (FIG. 10) onto a roof and identifies which direction the bent wire 125, which may also be generally referred to as a deflector, will pivot about a longitudinal pivot axis 172 relative to the plate 120. Alternative to a decal, the respective major surfaces of the plate 120 may be painted, powered coated, or otherwise affected in a manner that results in the major surfaces having differing colors, wherein one of the differing colors represents a deflection direction of deflector 125, which will be described in greater detail below.

The deflector 125, which may be formed from a bent wire, is secured to the first major surface 140 of plate 120 via straps 166 that are secured to the plate 120 via bolts 168. The straps 166 include looped bottom ends through which a portion of the wire 125 is inserted and a free rotation connection is established therebetween to effectuate the longitudinally extending pivot axis 172 about which the bent wire deflector 125 pivots. In one particular embodiment the pivot axis 172 is offset from the first major surface 140.

The deflector 125 may be formed from a single uniform, unibody bent wire, which may be made from stainless steel. The manner in which the bent wire deflector 125 is formed defines the release arm 126 and the deflector arm 128. In one particular embodiment, the deflector arm 128 is oriented generally or approximately orthogonal to the release arm 126, however the deflector arm 128 may be slightly non-orthogonally angled relative to the release arm 126 in some embodiments.

With continued reference to FIG. 8, the bent wire deflector 125 includes a longitudinally extending short portion 158 that extends through looped bottom ends of the straps 166 coaxially with longitudinal axis 172. A portion of wire 160 extends vertically downward from the longitudinally extending portion 158 and connects with the longitudinally extending release arm 126 via a rounded corner 162. The length of the portion 160 is sufficiently long enough to position the release arm 126 orthogonally below the pair of open hooks 124, which may also be referred to as a second pair of hooks when the pair of closed hooks 122 are referred to as a first pair of hooks. Another portion 164 of wire may extend inwardly from an inner end of longitudinal portion 158 and downwardly at an angle semi-tapered towards the vertical axis 144. The inner portion 164 of the bent wire deflector defines a bend, which may be on the order from about 45° to about 90°, and may typically be about 90°. The bend 170 in the bent wire deflector 145 effectuates and encourages the deflector 125 to pivot about the axis 172 as the hoist 110 is lowering a pallet 12 or 112 full of shingles 14. The wire continues to establish a portion 172 that acts as a crossbar or axle 174 for the wheels 130, which are freely connected thereto.

The release arm 126 is oriented offset and extends substantially parallel to the longitudinal pivot axis 172. More particularly, the release arm is positioned vertically below the pivot axis 172. Additionally, the release arm 126 extends in a substantially continuous and uniform manner between the rounded ends 162 which terminate outwardly relative to the vertical axis 144 from the second pair of hooks 124, which are the pair of open hooks. Similar to the first embodiment, the pair of closed hooks 122, which may also be referred to as a first pair of hooks, are positioned longitudinally outward from the second pair of hooks, which are the open hooks 124, relative to the vertical axis 144. Further, while the open hooks 124 are depicted as positioned inwardly from the closed hooks 122 relative to the vertical axis 144, it is entirely possible that their positions are switch such that the open hooks 124 are outward from the closed hooks 122 relative to the vertical axis 144. However, if this were the case, the deflector 125 would need to alter its shape to accommodate the release arm 126 to extend directly below the open hooks 124.

The longitudinal pivot axis 172 defined by the portion 158 of the bent wire deflector 125 is oriented vertically above the bottom edge 138 of the plate 120. The manner and the extension in which the bottom edge 138 is vertically lower than the axis of rotation 172 may assist the deflector and encourage the deflector to only rotate in a single deflecting manner so as to reduce the likelihood of rotating in the wrong direction. Stated otherwise, in operation, the bent wire deflector 125 is configured to deflect towards the direction of the first major surface 140 about the longitudinal axis 172. The portion of the wire would contact the bottom edge 138 discourage and prevent or block the bent wire deflector 125 from rotating about the axis 172 in the direction towards the second major surface 142.

Figure 10:
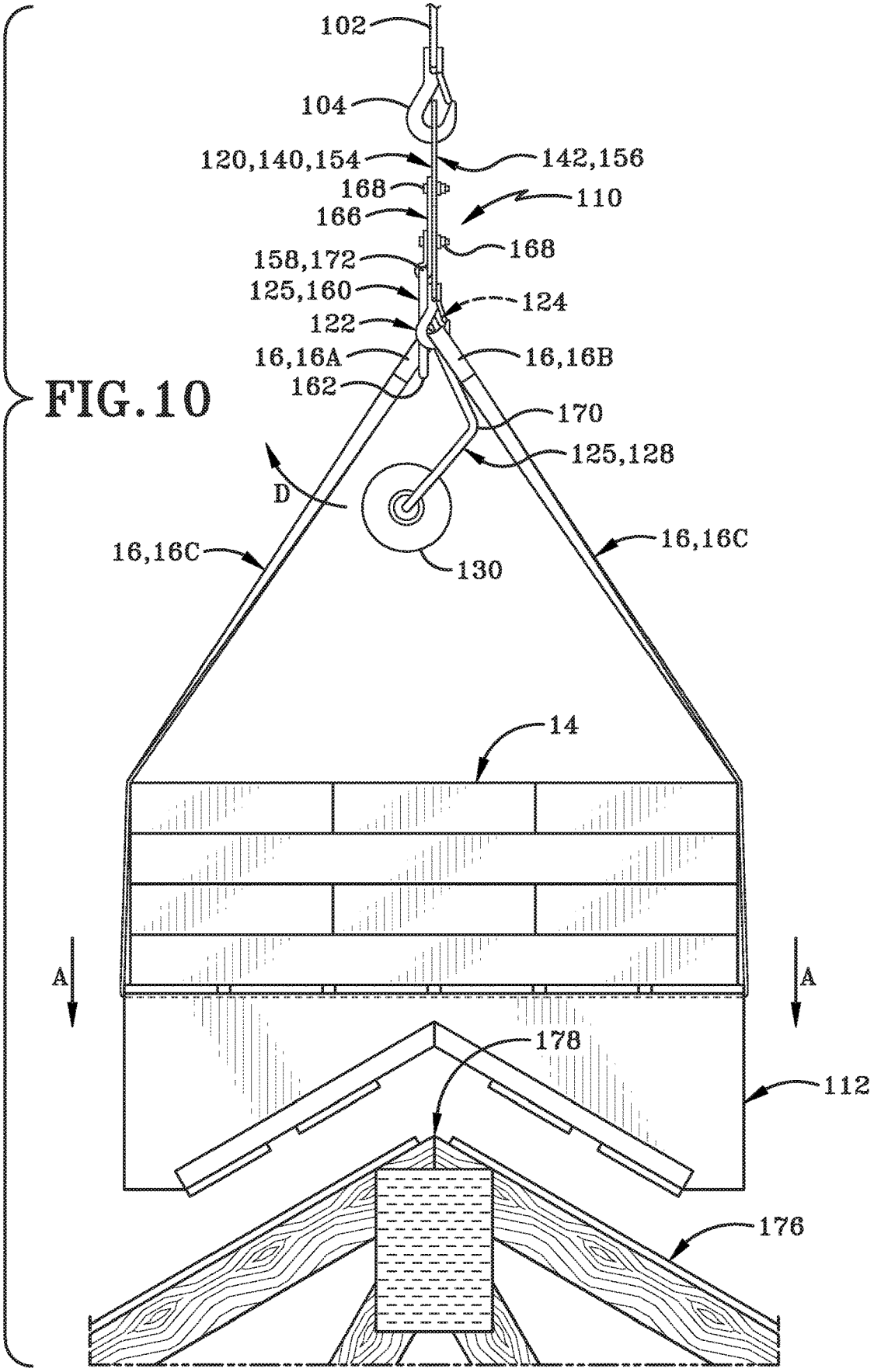
FIG. 10 (FIG. 10) is an operational side view of the hoist identified in FIG. 8 and FIG. 9 depicting the lowering of a particular pallet configured for a pitched roof to be lowered and installed thereon.

In operation and with reference to FIG. 10, the hoist 110 operates in a similar manner as the first embodiment described above. The hook 104 may be connected to the plate 120 so as to enable a cable 102 attached to a crane to lift a pallet 112 carrying shingles 14 thereon onto a rooftop. As the shingles are lowered, the pallet 112 may make contact with the roof 176. In one particular embodiment, the roof 176 may have a peak or an apex 178 and the pallet 112 at a complementary configuration to enable the pallet 112 to nest atop the apex 178 of the pitched roof 176. As the pallet 112 comes to rest atop the roof 176 adjacent its apex 178, the hoist 110 is continued to be lowered in the downward direction of arrow A. The wheels 130 will contact the top layer of shingles 14 supported by the pallet 112. The deflector 125 will pivot upwardly in the direction of arrow D which will cause the release arm 126 to pass by, near or adjacent the lower end of the open hooks 124 in order to release the first end 16A from the open hook 124. Similar to the first embodiment, once the free of the strap 16 is released from its releasable connection with hope hook 124, the hoist 110 may be lifted by the crane and pulled upwardly to remove the strap 16 underneath its connection with the pallet 112.

With continued reference to FIG. 10, the wheels 130 make contact with the upwardly facing surface of the load, which is in this case is shingles 14. Because the wheels 130 are positioned with a forward bias based on the bend at bend 170 in deflector 125, the wheels rotate about an axis defined crossbar or axle 174 by causing translation of the wheels, which is orthogonal to the direction of arrow A. The orthogonal translation of wheels 130 (i.e., towards the left in FIG. 10) occurs as the wheels rotate (i.e., in a counter clockwise manner in FIG. 10) about wheel rotation axis defined by axle 174. The translation of wheels 130 causes the deflector arm 128 pivot about pivot axis 172. Because of the rigid connection of bent wire deflector 135 defining the axle 174, the pivoting action of deflector arm 128 around pivot axis 172 causes the release arm 126 to rotate about axis 172 as well. The rotation of release arm 126 about axis 172 causes it to rotate upwardly in a direction of arrow D. The release arm 126 extends past the lowest portion of open hooks 124 effectuating a space therebetween. When the release arm 126 rotates upwardly about axis 172 in the direction of arrow D, the release arm 126 contacts end 16A and causes the first end 16A of strap 16 to be released from its looped engagement with the open hooks 124.

After the first end 16A of strap 16 has been disconnected from the open hooks 124, the crane may winds or lift cable 102 upwardly which lifts the hoist 110 and which enables the strap 16 to unthread or otherwise pass through or beneath a portion of the load. In this particular instance, the strap 16 passes through the pallet 112, above an apex portion of the pallet 112 frame and below the upper deck of the pallet that supports the shingles 14, and allows the pallet 112 to be fully supported by the pitched roof 176 and straddle apex 178. In accordance with an aspect of the present disclosure, the ability of the device 10 to unhook the first end 16A of the loop strap 16 enables the load, such as pallet 112 carrying shingles 14, to be placed upon a support surface (i.e., roof 176) without the need of an operator to unhook the straps 16 from various hooks on the hoisting device.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Also, various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of preforming the present disclosure may occur in a sequence different from those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the disclosure are an example and the disclosure is not limited to the exact details shown or described.

The invention claimed is:

1. A hoisting device for lifting and placing a pallet on a rooftop, the hoisting device comprising:

a support member including a first end and a second end defining a longitudinal direction therebetween, a first major surface opposite a second major surface defining a transverse direction therebetween, and a top and a bottom defining a vertical direction therebetween;

a hook connected to the support member adapted to connect with a first end of a strap;

an anchor coupled to the support member adapted to connect with a second end of the strap;

a deflector coupled to the support member configured to move between a first position and a second position, wherein the deflector passes the hook when moving from the first position and is adapted to release the first end of the strap from the hook after a load has been disposed at an intended location; and a forwardly biased portion of the deflector that translates in the transverse direction in response to the support member moving downwardly and the deflector moving from the first position while the load is supported by structure;

a release arm on the deflector positioned below the hook configured to pass by the hook and release the strap as the deflector moves from the first position to the second position; and a vertical portion of the deflector that is circular in cross section and offset from the hook.

2. The hoisting device of claim 1, further comprising a bent wire defining the forwardly biased portion of the deflector.

3. The hoisting device of claim 1, further comprising:

a bend in the deflector between the forwardly biased portion and the vertical portion defining an angle between about 45 degrees and about 90 degrees, wherein the bend encourages the deflector to pivot about a pivot axis from the first position to the second position.

4. The hoisting device of claim 3, further comprising:

a portion of the deflector extending downwardly and inwardly from the pivot axis towards the bend.

5. The hoisting device of claim 1, further comprising:

a first color associated with the first major surface adapted to identify the direction in which the deflector moves from the first position to the second position; and a different second color associated with the second major surface to identify a portion of the support member relative to which the deflector does not move towards when moving from the first position to the second position.

6. The hoisting device of claim 1, wherein the support member is a rigid plate having a length in the longitudinal direction that is greater than a height in the vertical direction that is greater than a width in the transverse direction, and further comprising:

a pivot axis parallel to the length in the longitudinal direction, wherein the deflector pivots about the pivot axis to move from the first position towards the second position.

7. The hoisting device of claim 6, further comprising:

a bottom edge of the plate wherein the hook extends vertically below the bottom edge.

8. The hoisting device of claim 7, wherein the pivot axis is vertically above the bottom edge.

9. The hoisting device of claim 8, wherein the top of the plate defines an apex and the plate includes downwardly and longitudinally inclined edges extending respectively outward to the first and second ends.

10. The hoisting device of claim 9, further comprising:

a hole formed in the rigid plate positioned above the pivot axis and below the apex configured to connect the plate with a hook on a cable connected to a crane.

11. A method of installing a pallet on a roof comprising:

lowering a hoist having a first end of a strap connected to an open hook and a second end of the strap connected to an anchor, wherein the hoist includes a rigid plate having a length in a longitudinal direction that is greater than a height in a vertical direction that is greater than a width in a transverse direction;

contacting a forwardly biased portion on the hoist with an object carried by the pallet;

pivoting a deflector about a pivot axis parallel to the longitudinal direction from a first position by the open hook; and releasing the first end of the strap from its connection with the open hook in response to a first portion of the deflector moving by the open hook.

12. The method of installing the pallet on the roof of claim 11, further comprising:

raising the hoist after the first end of the strap has been released; and pulling the strap through a portion of the pallet from the second end of the strap connected to a closed hook.

13. The method of installing the pallet on the roof of claim 12, further comprising:

pivoting a vertical portion of the deflector between the open hook and the closed hook.

14. The method of installing the pallet on the roof of claim 13, further comprising:

rotating the deflector in a direction towards a first major surface on the hoist; and precluding rotation of the deflector in a direction towards a second major surface on the hoist.

15. The method of installing the pallet on the roof of claim 12, further comprising:

translating the forwardly biased portion of the deflector in the transverse direction immediately after contacting the forwardly biased portion on the hoist with an object carried by the pallet.

16. A hoisting device for lifting and placing a pallet on a rooftop, the hoisting device comprising:

a support member including a first end and a second end defining a longitudinal direction therebetween, a first major surface opposite a second major surface defining a transverse direction therebetween, and a top and a bottom defining a vertical direction therebetween;

a hook connected to the support member adapted to connect with a first end of a strap;

an anchor coupled to the support member adapted to connect with a second end of the strap;

a deflector coupled to the support member configured to move between a first position and a second position, wherein the deflector passes the hook when moving from the first position and is adapted to release the first end of the strap from the hook after a load has been disposed at an intended location; and a forwardly biased portion of the deflector that translates in the transverse direction in response to the support member moving downwardly and the deflector moving from the first position while the load is supported by structure, wherein the forwardly biased portion of the deflector is defined by a bent wire.

* * * * *